US009098062B2

(12) United States Patent
Shinohara

(10) Patent No.: US 9,098,062 B2
(45) Date of Patent: Aug. 4, 2015

(54) PROCESS CARTRIDGE AND IMAGE FORMING APPARATUS

(75) Inventor: Seiichi Shinohara, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 352 days.

(21) Appl. No.: 13/389,161

(22) PCT Filed: Jan. 7, 2011

(86) PCT No.: PCT/JP2011/050591

§ 371 (c)(1),
(2), (4) Date: Feb. 6, 2012

(87) PCT Pub. No.: WO2011/083871

PCT Pub. Date: Jul. 14, 2011

(65) Prior Publication Data

US 2012/0134710 A1 May 31, 2012

(30) Foreign Application Priority Data

Jan. 8, 2010 (JP) ..... 2010-002878
Nov. 25, 2010 (JP) ..... 2010-262468

(51) Int. Cl.
*G03G 15/06* (2006.01)
*G03G 21/18* (2006.01)
(Continued)

(52) U.S. Cl.
CPC ..... *G03G 21/1814* (2013.01); *G03G 15/0812* (2013.01); *G03G 21/0011* (2013.01); *G03G 2215/0861* (2013.01)

(58) Field of Classification Search
CPC ..... G03G 15/0806; G03G 15/0808; G03G 15/081; G03G 15/0812; G03G 15/0813; G03G 15/0815; G03G 15/0817
USPC ..... 399/119, 258, 260, 263–265, 279, 283, 399/284, 286
See application file for complete search history.

(56) References Cited

U.S. PATENT DOCUMENTS 4,100,884 A 7/1978 Mochizuki et al.
4,967,231 A 10/1990 Hosya et al.
(Continued)

FOREIGN PATENT DOCUMENTS

JP 52-143831 11/1977
JP 1-191880 8/1989
(Continued)

OTHER PUBLICATIONS

Office Action in Chinese Patent Application No. 201180005314.5, dated Sep. 27, 2013 (with English translation).

*Primary Examiner* — Walter L Lindsay, Jr.
*Assistant Examiner* — Jessica L Eley
(74) *Attorney, Agent, or Firm* — Fitzpatrick, Cella, Harper & Scinto

(57) ABSTRACT

A process cartridge for an image forming apparatus includes a developing roller, including a shaft member and an elastic layer therearound, for developing operation while contacting an image bearing member with a peripheral speed difference; a toner supplying roller contactable to the developing roller; a regulating member, contactable to the developing roller, wherein a length of the regulating member is shorter than that of the developing roller; and a cleaning blade, contactable to the image bearing member. The developing roller has a region capable of carrying the toner regulated by the regulating member and a region, outside thereof, both of which regions are contactable to the image bearing member, wherein the cleaning blade extends over the regions when the cleaning blade is contacted to the image bearing member. The shaft member has an outer diameter in a region outside a first contact region between the regulating member and the developing roller, and an outer diameter in a second contact region between the toner supplying roller and the developing roller wherein the former outer diameter is smaller than the latter outer diameter.

8 Claims, 4 Drawing Sheets

(51) Int. Cl.
*G03G 15/08* (2006.01)
*G03G 21/00* (2006.01)

(56) References Cited

U.S. PATENT DOCUMENTS

| | | | | |
|---|---|---|---|---|
| 6,128,462 | A | 10/2000 | Kato et al. | |
| 6,169,869 | B1 | 1/2001 | Inami et al. | |
| 6,175,703 | B1 | 1/2001 | Nakazono et al. | |
| 6,317,574 | B1 | 11/2001 | Shinohara et al. | |
| 6,337,964 | B2 | 1/2002 | Inami et al. | |
| 6,978,100 | B2 | 12/2005 | Yasui et al. | |
| 7,155,137 | B2 | 12/2006 | Yasui et al. | |
| 2007/0003330 | A1* | 1/2007 | Lee | 399/286 |
| 2009/0110444 | A1* | 4/2009 | Yamada et al. | 399/284 |
| 2009/0148189 | A1* | 6/2009 | Fukazawa | 399/238 |
| 2009/0290900 | A1* | 11/2009 | Maeda et al. | 399/103 |

FOREIGN PATENT DOCUMENTS

| | | |
|---|---|---|
| JP | 10-167505 | 6/1998 |
| JP | 2001-125367 | 5/2001 |
| JP | 2001-134076 | 5/2001 |
| JP | 2006-126719 A | 5/2006 |
| JP | 2008-033122 | 2/2008 |
| JP | 2009-222970 | 10/2009 |

* cited by examiner (a)

(b)

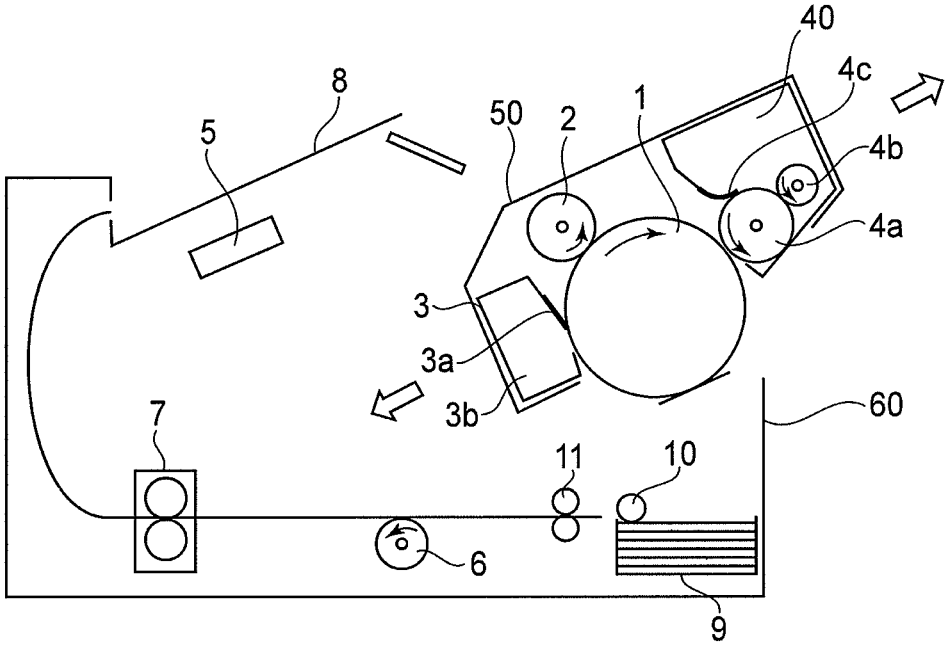
(a)
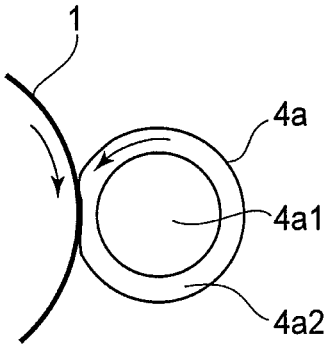
(b)
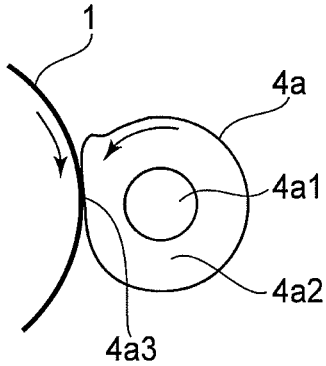

PROCESS CARTRIDGE AND IMAGE FORMING APPARATUS

TECHNICAL FIELD

The present invention relates to an electrophotographic image forming apparatus, and a process cartridge which is removably mountable in the main assembly of an electrophotographic image forming apparatus.

BACKGROUND ART

There have been known image forming apparatuses which use a developing method of the so-called contact type, that is, image forming apparatuses which form an electrostatic latent image on their rotatable image bearing member, and develop the electrostatic latent image by placing their development roller in contact with the peripheral surface of the image bearing member. It is possible that the usage of the developing method of the contact type will damage the peripheral surface of an image bearing member. Therefore, in order to prevent the peripheral surface of an image bearing member from being damaged by a development roller, many image forming apparatuses, which use the developing method of the contact type, employ an elastic development roller, which comprises: a metallic core; and an elastic surface layer which covers the entirety of the peripheral surface of the metallic core. The elastic development roller, however, suffers from the following problem. That is, the elastic surface layer of an elastic development roller is in contact with the peripheral surface of an image bearing member, and therefore, is gradually shaved by the peripheral surface of the image bearing member. Thus, the fine particles which result from the shaving of the peripheral surface of the elastic layer of a development roller travel to the cleaning edge of a cleaning blade, causing thereby the cleaning blade to shudder, chatter, and/or lap, which in turn generates abnormal sounds, makes the peripheral surface of the image bearing member unsatisfactorily cleaned, and/or causes the like problem. In other words, as the peripheral surface of a development roller is shaved by the peripheral surface of a photosensitive member, it becomes difficult for the image forming apparatus to output images which are satisfactory to users. In terms of the lengthwise direction of a development roller, it is likely to be across the end portions (portions which are not supplied with toner) that the elastic layer of a development roller is shaved. Thus, there have been proposed various arts for minimizing the amount by which the elastic layer of the development roller of an image forming apparatus which uses a developing method of the contact type is shaved. Some of these arts have been disclosed in Japanese Laid-open Patent Applications S52-143831, and H01-191880 (Patent Documents 1 and 2, respectively).

The above-mentioned prior arts, however, suffer from the following problems. That is, according to these arts, in order to prevent the elastic layer of a development roller from being shaved, the elastic layer is to be uniformly increased in hardness across the entirety in terms of the lengthwise direction of the development roller. However, the increase in the hardness of the elastic layer of a development roller increases the amount of the pressure to which the toner on the peripheral surface of the elastic layer of the development roller is subjected, which in turn accelerates toner deterioration. Toner deterioration causes an image forming apparatus to output unsatisfactory images, in particular, foggy images.

According to the art disclosed in the second patent document, the elastic layer is formed of foamed material, and the entirety of its peripheral surface is covered with a piece of seamless tube. This art also is problematic in that it substantially increases a development roller in manufacture cost.

DISCLOSURE OF THE INVENTION

Thus, the primary object of the present invention is to provide a combination of an image forming apparatus and a process cartridge therefor, which uses a development method of the contact type, and yet, is inexpensive to manufacture, substantially lower in the amount by which its development roller is shaved, and unlikely to suffer from the problems related to its cleaning blade.

According to an aspect of the present invention, there is provided a process cartridge detachably mountable to a main assembly of the apparatus of an image forming apparatus, comprising an image bearing member on which an electrostatic image is to be formed; a developing roller, including a shaft member and an elastic layer therearound, for developing the electrostatic image while contacting a surface of said image bearing member with a peripheral speed difference; a toner supplying roller contactable to said developing roller; a regulating member, contactable to said developing roller, for regulating a layer thickness of toner carried on a surface of the developing roller, wherein a length of said regulating member measured in a rotational axial direction of said developing roller is shorter than that of said developing roller; and a cleaning blade, contactable to said image bearing member, for cleaning the surface of said image bearing member; wherein said developing roller has a region capable of carrying the toner regulated by said regulating member and a region, outside thereof, not carrying the toner, both of which regions are contactable to said image bearing member, wherein said cleaning blade extends over said regions when said cleaning blade is contacted to said image bearing member, wherein said regions are different with respect to the rotational axis direction, and wherein said shaft member has an outer diameter in a region outside a first contact region between said regulating member and said developing roller, and an outer diameter in a second contact region between said toner supplying roller and said developing roller wherein the former outer diameter is smaller than the latter outer diameter.

These and other objects, features, and advantages of the present invention will become more apparent upon consideration of the following description of the preferred embodiments of the present invention, taken in conjunction with the accompanying drawings.

BRIEF DESCRIPTION OF THE DRAWINGS

FIG. 4 is a schematic sectional view of a combination of the process cartridge in accordance with the present invention and the main assembly of the image forming apparatus in accordance with the present invention.

FIG. 5 is a schematic sectional view of the area of contact between a development roller and an image bearing member, and shows the states of contact between the development roller and image bearing member.

BEST MODE FOR CARRYING OUT THE INVENTION

Hereinafter, a preferred embodiment of the present invention is described in detail with reference to the appended drawings. The measurements, materials, and shapes of the structural components of the image forming apparatus, and their positional relationship, which will be mentioned in the description of the embodiment, are not intended to limit the present invention in scope, unless specifically noted.

Embodiment

Figure 1:
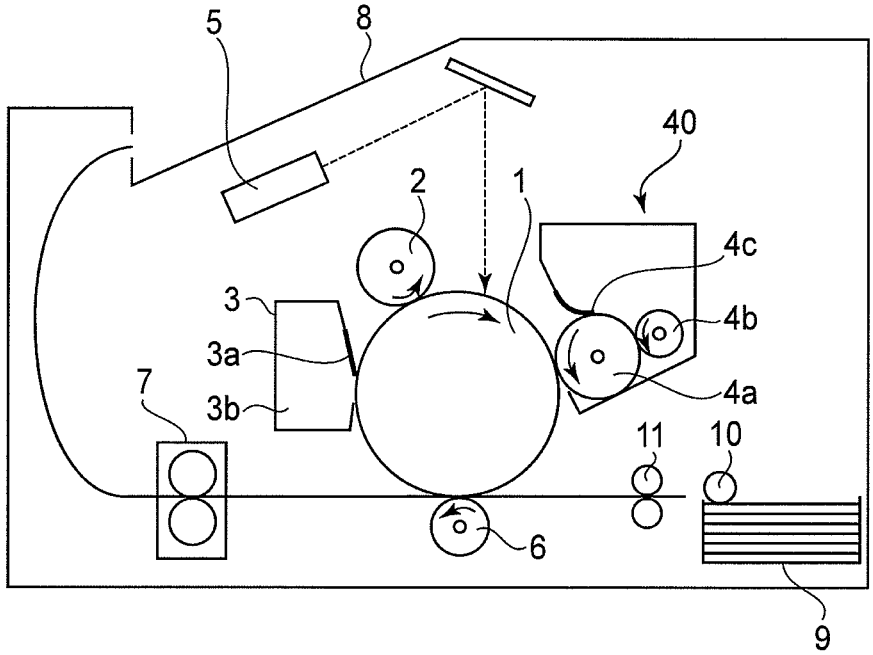
FIG. 1 is a schematic sectional view of the image forming apparatus in the preferred embodiment of the present invention, and shows the general structure of the apparatus.
Figure 1:
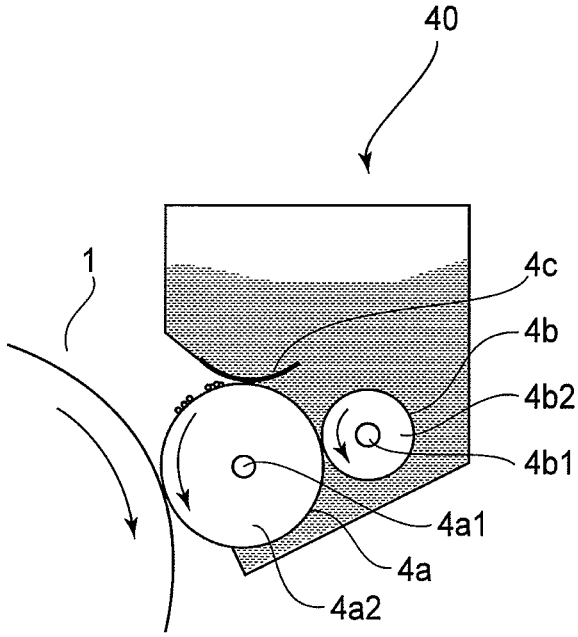
Figure 2:
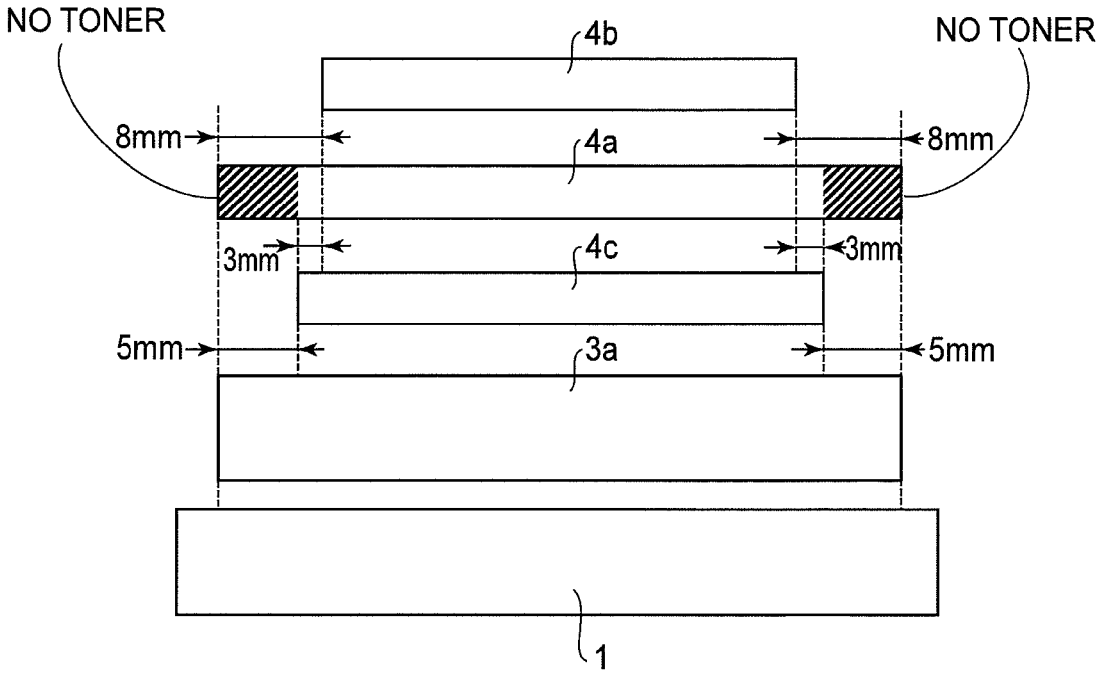
FIG. 2 is a schematic drawing which shows the portion of a development roller, which is coated with toner, and the portions of the development roller, which are not coated with toner.
Figure 3:
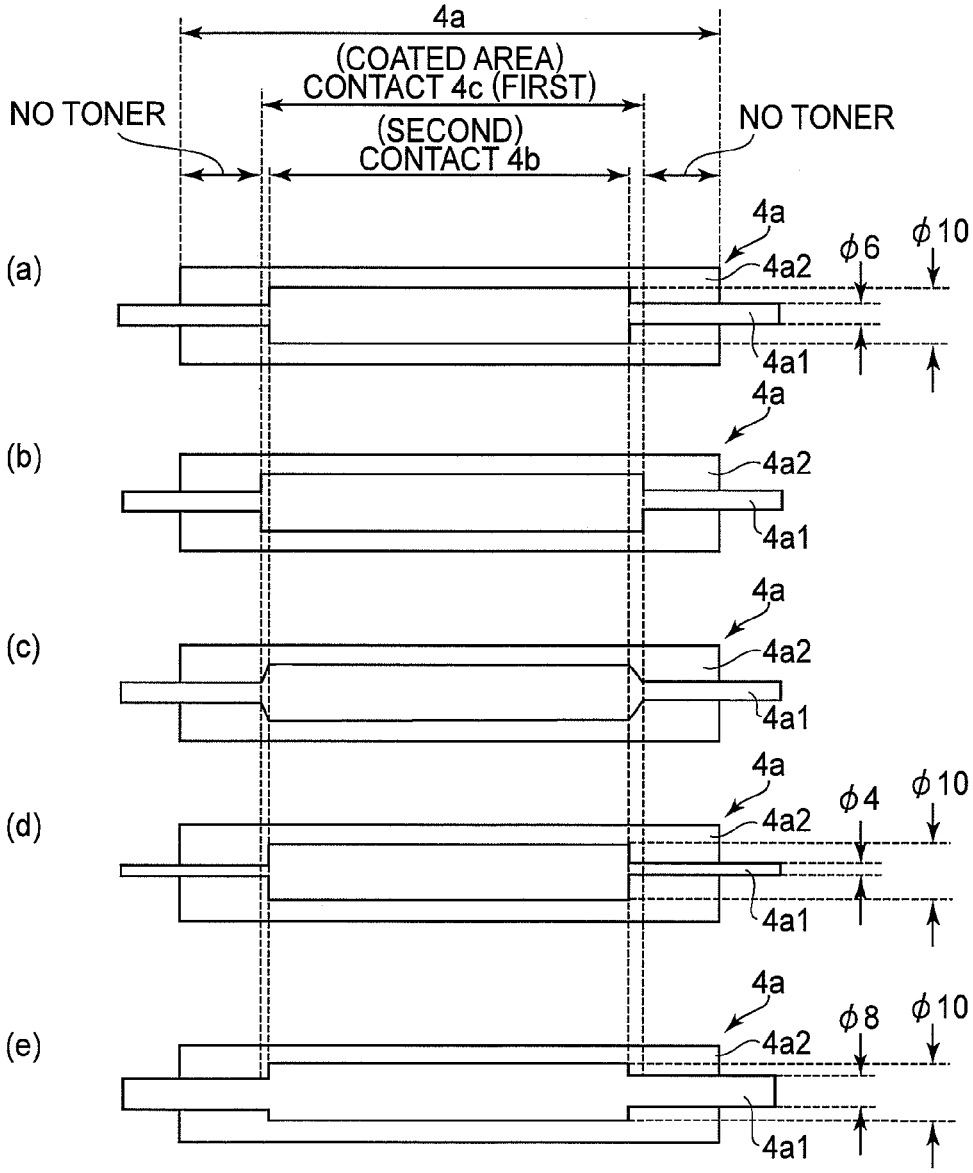
FIG. 3 is a schematic sectional view of a development roller in the preferred embodiment of the present invention.

First, referring to FIGS. 1-3, the preferred embodiment of the present invention is described. The image forming apparatus in this embodiment is a laser beam printer which uses an electrophotographic image forming method.

(1) General Structure of Image Forming Apparatus

Referring to FIG. 1(*a*), the general structure of the image forming apparatus in this embodiment is described. FIG. 1(*a*) is a schematic sectional view of the image forming apparatus in this embodiment, and shows the general structure of the apparatus.

The image forming apparatus has a photosensitive drum 1 (image bearing member) which is rotatable by an unshown power source, in the direction indicated by an arrow mark in FIG. 1(*a*). It has also a charge roller 2, a developing apparatus 40, a transfer roller 6 (transferring apparatus), and a cleaning apparatus 3, listing from the most upstream one in terms of the rotational direction of the photosensitive drum 1, which are in the adjacencies of the peripheral surface of the photosensitive drum 1. The image forming apparatus has also an exposing apparatus 5 which scans (exposes) the peripheral surface of the photosensitive drum 1 with the beam of laser light it projects. The exposing apparatus 5 is above the photosensitive drum 1.

The image forming operation carried out by the image forming apparatus structured as described above is as follows. First, charge voltage is applied to the charge roller 2, whereby the peripheral surface of the photosensitive drum 1 is uniformly charged to the same polarity as toner. Then, the charged portion of the peripheral surface of the photosensitive drum 1 is scanned (exposed) by the beam of laser light projected by the exposing apparatus 5, whereby an electrostatic latent image is formed on the peripheral surface of the photosensitive drum 1. Then, toner is supplied to the electrostatic latent image from the developing apparatus 40, whereby the electrostatic latent image is developed into a visible image, that is, an image formed of toner (which hereafter will be referred to as toner image). After the formation of the toner image through the above-described process, the toner image is transferred onto a sheet of recording medium, in the transfer nip which the photosensitive drum 1 and transfer roller 6 form. After the transfer of the toner image onto the sheet of recording medium, the sheet is conveyed to a fixing apparatus 7, in which the toner image is fixed to the sheet. Then, the sheet is discharged into a delivery tray 8, which is a part of the top wall of the main assembly of the image forming apparatus. The sheet of recording medium is storable in layers in a sheet feeder cassette 9. As an image forming operation is started, each sheet of recording medium is conveyed one by one to the transfer nip from the sheet feeder cassette 9 by way of a feed roller 10, a pair of sheet conveyance rollers, and the like, with a preset timing. Incidentally, in this embodiment, the toner image is directly transferred onto the sheet of recording medium from the photosensitive drum 1. However, the present invention is also compatible with an intermediary transfer member (intermediary transfer belt, or the like) which is employed by a full-color image forming apparatus or the like.

After the transfer of the toner image, there remains on the peripheral surface of the photosensitive drum 1, the toner which failed to be transferred onto the sheet of recording medium (which hereafter will be referred to as residual toner) from the peripheral surface of the photosensitive drum 1. This is why the image forming apparatus is provided with the cleaning apparatus 3, which is for removing the residual toner from the peripheral surface of the photosensitive drum 1. The cleaning apparatus 3 has a cleaning blade 3*a* and a waste toner container 3*b*. The cleaning blade 3*a* is formed of urethane rubber or silicon rubber, and is in contact with the peripheral surface of the photosensitive drum 1 by its cleaning edge portion. More specifically, the cleaning edge of the cleaning blade 3*a* is in contact with the peripheral surface of the photosensitive drum 1 in such a manner that its cleaning edge is on the upstream side of its base in terms of the rotational direction of the photosensitive drum 1. Thus, as the photosensitive drum 1 is rotated, it is possible for the cleaning edge of the cleaning blade 3*a* to scrape away (remove) the residual toner from the peripheral surface of the photosensitive drum 1. The residual toner is storable in the waste toner container as it is scraped away, and can be used again for the next image forming operation and thereafter. Incidentally, the present invention is also compatible with an image forming apparatus, the main assembly 60 of which is structured so that a process cartridge 50, which is an integral combination of the above described photosensitive drum 1, charge roller 2, developing apparatus 40, and cleaning apparatus 3, is removably mountable, as shown in FIG. 4. Further, the present invention is also compatible with an image forming apparatus, the charge roller 2 of which is not an integral part of the process cartridge 50. That is, the present invention is also compatible with an image forming apparatus, the charge roller 2 of which is a part of the apparatus main assembly 60.

(2) General Structure of Developing Apparatus

Next, referring to FIG. 1(*b*), the general structure of the developing apparatus 40 in this embodiment is described. FIG. 1(*b*) is a schematic sectional view of the developing apparatus 40 in this embodiment. The developing apparatus 40 in this embodiment develops an electrostatic latent image with the use of nonmagnetic single-component toner, and contains nonmagnetic single-component toner, which is negatively chargeable.

The developing apparatus 40 has a development roller 4*a* and a toner supply roller 4*b*. The development roller 4*a* is cylindrical, and supplies toner to the peripheral surface of the photosensitive drum 1 by being placed in contact with the peripheral surface of the photosensitive drum 1 while bearing toner on its peripheral surface. The toner supply roller 4*b* supplies the peripheral surface of the development roller 4*a* with toner by being placed in contact with the peripheral surface of the development roller 4*a*. One of the external walls of the frame of the developing apparatus 40 is provided with an opening, through which the development roller 4*a* is exposed from the developing apparatus 40. It is through this opening that the development roller 4*a* is in contact with the peripheral surface of the photosensitive drum 1. The developing apparatus 40 has also a toner layer thickness regulation blade 4*c*, which is virtually in contact with the peripheral surface of the development roller 4*a* and regulates in thickness the toner layer which the toner in the development apparatus 40 forms on the peripheral surface of the development roller 4*a* as the toner is borne on the peripheral surface of the development roller 4*a*.

The development roller 4*a* has a metallic core 4*a*1 (axial member), an NBR layer 4*a*2 (elastic layer), and an acrylic-urethane layer. The metallic core 4*a*1 is electrically conductive, and is in connection with an unshown electric power source. The NBR layer 4*a*2 covers the entirety of the peripheral surface of the metallic core 4*a*1. The acrylic-urethane rubber layer covers the entirety of the peripheral surface of the NBR layer 4*a*2. The development roller 4*a* is 16 mm in overall diameter. The development roller 4*a* has acrylic resin particles, which are dispersed in the surface portion of the development roller 4*a*. The acrylic resin particles provide the peripheral surface of the development roller 4*a* with a certain amount of roughness. Thus, the development roller 4*a* is 10 μm in surface roughness (Rzjis). Further, the development roller 4*a* is $1.0\times10^{4}\Omega$ in volume resistivity. Since the development roller 4*a* is structured as described above, the toner on the peripheral surface of the development roller 4*a* can be electrostatically supplied to the peripheral surface of the photosensitive drum 1 by applying development voltage to the metallic core 4*a*1 of the development roller 4*a* from an unshown electric power source. In order to ensure that the toner is supplied to the peripheral surface of the photosensitive drum 1 by a satisfactory amount, the peripheral velocity of the development roller 4*a* is set to be faster than the rotational speed (peripheral velocity) of the photosensitive drum 1. That is, when toner is on the peripheral surface of the development roller 4*a*, and the development roller 4*a* is rotated, there is a difference in peripheral velocity between the development roller 4*a* and photosensitive drum 1. More specifically, in this embodiment, the peripheral velocity of the development roller 4*a* is set to a value which is 140% of the peripheral surface of the photosensitive drum 1.

However, the peripheral velocity of the development roller 4*a* and that of the photosensitive drum 1 do not need to be set as described above. That is, all that is necessary is that they are properly set in consideration of the structure of an image forming apparatus (for example, they may be set so that the ratio in peripheral velocity between the development roller 4*a* and photosensitive drum 1 is in range of 100-200%).

The toner supply roller 4*b* also is an elastic roller, and is made up of a metallic core 4*b*1 and an elastic layer 4*b*2. The metallic core 4*b*1 is electrically conductive, and is 6 mm in diameter. The elastic layer 4*b*2 is formed of urethane sponge, and covers the entirety of the peripheral surface of the metallic core 4*b*1. The minute pores in the urethane sponge used as the material for the toner supply roller 4*b* are continuous. The toner supply roller 4*b* is rotatable in the same direction as the development roller 4*a*. Since the development roller 4*a* and toner supply roller 4*b* are structured as described above, the toner in the developing apparatus 40 can be supplied to the peripheral surface of the development roller 4*a* by way of the peripheral surface of the toner supply roller 4*b*. Further, the toner particles which remain on the peripheral surface of the development roller 4*a* after the development of the electrostatic latent image on the peripheral surface of the photosensitive drum 1, that is, the toner particles on the peripheral surface of the development roller 4*a*, which were not supplied to the peripheral surface of the photosensitive drum 1, can be scraped away by the toner supply roller 4*b*.

The toner layer thickness regulation blade 4*c* (toner layer thickness regulating member) is a blade formed of phosphor bronze, and is supported by the frame of the developing apparatus 40 in such a manner that its regulating portion is in contact with the peripheral surface of the development roller 4*a*. Thus, as the development roller 4*a* is rotated, the toner layer thickness regulation blade 4*c* glides on the peripheral surface of the development roller 4*a* while forming (coating) the body of toner on the peripheral surface of the development roller 4*a* into a thin layer of toner. Incidentally, as the substances usable as the material for the toner layer thickness regulation blade 4*c* (which hereafter will be referred to simply as regulation blade 4*c*), various metals other than phosphor bronze can be used in the form of an elastic thin plate. Further, various elastic rubber can be listed as the material for the regulating blade 4*c*.

Since the development roller 4*a* is partially exposed through the abovementioned opening of the frame of the developing apparatus 40, the developing apparatus 40 is also provided with an end seal (unshown), which is for keeping sealed the gap between the peripheral surface of the development roller 4*a* and the edges of the opening. The provision of the end seal prevents toner from spilling out of the developing apparatus 40 through the opening.

(3) Measurements of Development Roller, Toner Supply Roller, Regulation Blade, and End Seals Next, referring to FIG. 2, the measurements of the development roller 4*a*, toner layer thickness regulation blade 4*c*, and cleaning blade 3*a*, in terms of the direction parallel to the rotational axis of the development roller 4*a*, are described.

In terms of the direction parallel to the axial line of the development roller 4*a*, the measurement of the toner supply roller 4*b* and regulation blade 4*c* is generally less than the measurement of the development roller 4*a*. Thus, the toner supply roller 4*b* and regulation blade 4*c* do not contact the lengthwise end portions of the development roller 4*a*. Therefore, the lengthwise end portions of the development roller 4*a* are not coated with toner, remaining thereby virtually free of toner (they do not bear toner). The reason why the development roller 4*a* is provided with the toner-free portions is as follows. That is, if the measurement of the toner supply roller 4*b* is the same as, or more than, that of the development roller 4*a*, and therefore, the development roller 4*a* has no toner-free portions, some of the toner supplied to the peripheral surface of the development roller 4*a* by the toner supply roller 4*b* fails to remain borne on the peripheral surface of the development roller 4*a*; it falls from the development roller 4*a* and/or leaking out of the developing apparatus 40, making it possible for the main assembly of the image forming apparatus to be soiled by the toner having leaked out of the developing apparatus 40. In order to prevent the occurrence of this problematic phenomenon, it is necessary for the image forming apparatus and developing apparatus 40 to be structured to ensure that the toner supplied to the peripheral surface of the development roller 4*a* remains borne in entirety on the peripheral surface of the development roller 4*a* regardless of the amount by which toner is supplied to the peripheral surface of the development roller 4*a* by the toner supply roller 4*b*. Thus, in order to prevent the problem that toner falls from the development roller 4*a* at the edges of the development roller 4*a* and/or leaks out of the developing apparatus 40, that is, in order to ensure that the toner supplied to the peripheral surface of the development roller 4*a* remains borne in entirety on the peripheral surface of the development roller 4*a*, the toner supply roller 4*b* and regulation blade 4*c* are made smaller in measurement in terms of the direction parallel to the axial line of the development roller 4*a* than the development roller 4*a*, in order to intentionally provide the development roller 4*a* with "toner-free portions". Thus, from the standpoint of preventing the above described toner leak, it is mandatory to structure the developing apparatus 40 so that the peripheral surface of the lengthwise end portions of the development roller 4*a* remain free of toner.

In this embodiment, therefore, the development roller 4*a*, toner supply roller 4*b*, and regulation blade 4*c* are made so that in terms of the direction parallel to the axial line of the development roller 4*a*, the measurement of the regulation blade 4*c* is less than that of the development roller 4*a*, and the measurement of the toner supply roller 4*b* is less than that of the regulation blade 4*c*. That is, they are made so that in terms of measurement in the direction parallel to the axial line of the development roller 4*a*, their relationship in terms of measurement becomes: development roller 4*a*>regulation blade 4*c*> toner supply roller 4*b*. Incidentally, in terms of the direction parallel to the rotational axis of the development roller 4*a*, the measurement of the cleaning blade 3*a* is roughly the same as that of the development roller 4*a*.

More concretely, referring to FIG. 2, in terms of the direction parallel to the axial line of the development roller 4*a*, the development roller 4*a* extends by 8 mm beyond both of the lengthwise ends of the toner supply roller 4*b*. The regulation blade 4*c* extends by 3 mm beyond the both of the lengthwise ends of the toner supply roller 4*b*. The cleaning blade 3*a* is roughly the same in measurement as the development roller 4*a*. Since the development roller 4*a*, toner supply roller 4*b*, and cleaning blade 3*a* are made as described above in terms of their measurement, the lengthwise end portions of the development roller 4*a*, which are 5 mm in dimension, remain virtually free of toner; the lengthwise end portions of the development roller 4*a* are "toner-free portion" (hatched portion). Hereafter, in this embodiment, the portion of the peripheral surface of the development roller 4*a*, which is coated with a toner layer, which is controlled in thickness by coming into contact with the regulation blade 4*c*, may be referred to as a "toner bearing portion". In terms of the axial direction of the development roller 4*a*, the abovementioned "toner-free portions" are outside the "toner bearing portion". Also in terms of the direction parallel to the axial line of the development roller 4*a*, the measurement of the cleaning blade 3*a* is less than the measurement of the photosensitive drum 1. In other words, in terms of the direction parallel to the axial line of the photosensitive drum 1, the measurement of the cleaning blade 3*a* is such that the cleaning blade 3*a* straddles both the toner-free and toner bearing portions of the peripheral surface of the photosensitive drum 1, being in contact with the entirety of the toner bearing portion of the peripheral surface of the photosensitive drum 1, and a part of each of the toner-free portions.

(4) Structural Arrangement for Prevention of Shaving of Elastic Layer of Development Roller The surface of the elastic layer 4*a*2 of the development roller 4*a*, in particular, the toner-free portion, is shaved by the peripheral surface of the photosensitive drum 1 as it rubs against the peripheral surface of the photosensitive drum 1, which results in the unsatisfactory cleaning of the peripheral surface of the photosensitive drum 1, and/or formation of unsatisfactory images by the image forming apparatus. The toner-free portion of the peripheral surface of the development roller 4*a* has virtually no toner which plays the role of lubricant between itself and the peripheral surface of the photosensitive drum 1. Thus, the friction between the toner-free portion of the peripheral surface of the development roller 4*a* and the peripheral surface of the photosensitive drum 1 is greater than the friction between the other portion of the peripheral surface of the development roller 4*a* and the peripheral surface of the photosensitive drum 1. Therefore, the amount by which the toner-free portion of the peripheral surface of the development roller 4*a* is shaved by the peripheral surface of the photosensitive drum 1 is greater than the amount by which the toner bearing portion of the development roller 4*a* is shaved by the peripheral surface of the photosensitive drum 1. Further, the friction between the peripheral surface of the development roller 4*a* and the peripheral surface of the photosensitive drum 1 is greater when there is a difference in peripheral velocity between the photosensitive drum 1 and development roller 4*a* than when there is no difference in peripheral velocity between the development roller 4*a* and photosensitive drum 1. That is, the greater the amount of difference in peripheral velocity between the development roller 4*a* and photosensitive drum 1, the greater the abovementioned difference between the amount by which the toner-free portion of the peripheral surface of the development roller 4*a* is shaved by the peripheral surface of the photosensitive drum 1, and the amount by which the toner bearing portion of the development roller 4*a* is shaved by the peripheral surface of the photosensitive drum 1. In this embodiment, therefore, in order to reduce as much as possible the amount by which the toner-free portion of the peripheral surface of the elastic layer 4*a*2 of the development roller 4*a* is shaved by the peripheral surface of the photosensitive drum 1, the development roller 4*a* is formed so that its toner-free portion is less in hardness than its toner bearing portion.

More concretely, the metallic core 4*a*1 is formed so that its portion which corresponds in position to the toner-free portion of the peripheral surface of the elastic layer 4*a*2 is smaller in diameter than its portion which corresponds in position to the toner bearing portion of the peripheral surface of the elastic layer 4*a*2. This structural feature of the development roller 4*a* (metallic core 4*a*1) reduces the amount by which stress is generated in the toner-free portions of the peripheral surface portion of the elastic layer 4*a*2 of the development roller 4*a*, in the direction parallel to the rotational direction of the development roller 4*a*, being therefore capable of reducing the amount by which the toner-free portion of the elastic layer 4*a*2 is shaved by the peripheral surface of the photosensitive drum 1. Next, referring to FIG. 5, the reason why the above described structural arrangement for the development roller 4*a* (metallic core 4*a*1) can reduce the amount by which the toner-free portion of the elastic layer 4*a*2 of the development roller 4*a* is shaved by the peripheral surface of the photosensitive drum 1 is described. FIG. 5(*a*) is a schematic sectional view of a combination of the peripheral surface of the photosensitive drum 1, and the toner-free portion of the development roller 4*a*, which is the same in metallic core diameter as the toner bearing portion of the development roller 4*a*. FIG. 5(*b*) is a schematic sectional view of a combination of the peripheral surface of the photosensitive drum 1, and the toner-free portion of the development roller 4*a*, which is smaller in metallic core diameter than the toner bearing portion of the development roller 4*a*. Making the development roller 4*a* so that the portion of its metallic core 4*a*1, which corresponds in position to the toner-free portion of its elastic layer 4*a*2, is the same in diameter as the portion of its metallic core 4*a*1, which corresponds in position to the toner bearing portion of its elastic layer 4*a*2 makes the toner-free portion of the elastic layer 4*a*2 as thin and hard as the toner bearing portion of the elastic layer 4*a*2. Thus, as the peripheral surface of the development roller 4*a* is subjected to a large amount of the friction generated between itself and the peripheral surface of the photosensitive drum 1 by the photosensitive drum 1 because of the difference in peripheral velocity between the development roller 4*a* and photosensitive drum 1, the surface portion of the toner-free portion of the elastic layer 4*a*2, is not capable of surrendering to the force applied thereto in the direction parallel to its circumferential direction, as shown in FIG. 5(*a*). Therefore, this portion of the elastic layer 4*a*2 is likely to be shaved away by the peripheral surface of the photosensitive drum 1 by a relatively large amount, since it is not coated with toner, which functions as lubricant. In comparison, if the development roller 4*a* is made so that the portions of the metallic core 4*a*1, which corresponds in position to the toner-free portion of the elastic layer 4*a*2, is smaller in diameter than the portion of the metallic core 4*a*1, which corresponds in position to the toner bearing portion of the elastic layer 4*a*2, the toner-free portion of the elastic layer 4*a*2 is thicker and softer than the portion of the elastic layer 4*a*2, which corresponds in position to the large diameter portion of the metallic core 4*a*2. Therefore, as the peripheral surface of the development roller 4*a* is subjected to a large amount of the friction generated between itself and the peripheral surface of the photosensitive drum 1 by the photosensitive drum 1 because of the difference in peripheral velocity between the development roller 4*a* and photosensitive drum 1, this surface portion of the elastic layer 4*a*2 is capable of surrendering to the force applied thereto in the direction parallel to its circumferential direction, in such a manner that it deforms upstream of the nip 4*a*3 in terms of the rotational direction of the development roller 4*a*, as shown in FIG. 5(*b*). Thus, the amount by which stress is generated in this portion of the surface portion of the elastic layer 4*a*2 in the circumferential direction of the development roller 4*a* is lessened by this deformation. Therefore, the amount by which this portion of the elastic layer 4*a*2 is shaved away by the peripheral surface of the photosensitive drum 1 is smaller than the amount by which the toner-free portion of the elastic layer 4*a*2 is shaved away by the peripheral surface of the photosensitive drum 1 in a case where the portion of the metallic core 4*a*1, which corresponds in position to the toner-free portion of the elastic layer 4*a*2, is as large in diameter as the portion of the metallic core 4*a*1, which corresponds in position to the toner bearing portion of the elastic layer 4*a*2. Incidentally, the toner bearing portion of the development roller 4*a* is relatively large in metallic core diameter, being therefore sufficient in hardness. Therefore, the contact pressure between the peripheral surface of this portion of the development roller 4*a* and the peripheral surface of the photosensitive drum 1 remains large enough to ensure that the toner is supplied from the peripheral surface of the development roller 4*a* onto the peripheral surface of the photosensitive drum 1 by a satisfactory amount. Further, the toner on the peripheral surface of the toner bearing portion of the development roller 4*a* functions as friction reducing agent (lubricant), minimizing thereby the amount by which this portion of the elastic layer 4*a*2 of the development roller 4*a* is shaved away by the peripheral surface of the photosensitive drum 1.

(5) Measurements of Metallic Core

Next, referring to FIG. 3, the measurements of the metallic core 4*a*1 is described. FIGS. 3(*a*)-3(*e*) are schematic sectional views of the development roller 4*a* at a plane which coincides with the axial line of the development roller 4*a*. In terms of the direction parallel to the rotational axis of the development roller 4*a*, the area of contact between the regulation blade 4*c* and development roller 4*a* will be referred to as the first area of contact, hereafter. As the body of toner supplied to the peripheral surface of the development roller 4*a* by the toner supply roller 4*b* is moved past the regulation blade 4*c*, the body of toner is formed into a thin layer of toner, while being regulated in thickness to become uniform in thickness, by the regulation blade 4*c*. Thus, the peripheral surface of the development roller 4*a* is coated with the thin layer of toner across the area which corresponds in width to the regulation blade 4*c* in terms of the lengthwise direction of the development roller 4*a*. That is, the portions of the development roller 4*a*, which are outside the toner bearing portion of the development roller 4*a* remain free of toner. Also in terms of the direction parallel to the rotational axis of the development roller 4*a*, the area of contact between the toner supply roller 4*b* and development roller 4*a* will be referred to as the second area of contact, hereafter. It is across the portion of the development roller 4*a*, which corresponds in position to the second area of contact, that the development roller 4*a* is supplied with toner by the toner supply roller 4*b*. In this embodiment, the developing apparatus 4*a* is structured so that in terms of the direction parallel to the axial line of the development roller 4*a*, the portion of the metallic core 4*a*1, which is outside the second area of contact (toner bearing portion) is smaller in diameter than the portion of the metallic core 4*a*1, which is within the second area of contact. In other words, the development roller 4*a* is made so that its toner-free portion, the surface layer of which is more likely to be shaved by the peripheral surface of the photosensitive drum 1, is smaller in metallic core diameter, being therefore softer, whereas its portion which corresponds in position to the second area of contact, being therefore greater in the amount of pressure which the toner supply roller 4*b* and photosensitive drum apply, is larger in metallic core diameter, being therefore smaller in the amount of deformation of the elastic layer 4*a*1 attributable to the pressure from the toner supply roller 4*b* and photosensitive drum 1. Therefore, the development roller 4*a* remains uniform in shape in terms of its axial direction.

<Version 1 (FIG. 3(*a*))>

In this embodiment, the portion of the metallic core 4*a*1, which corresponds in position to the toner bearing portion of the development roller 4*a* is 10 mm in diameter, whereas the portion of the metallic core 4*a*1, which corresponds in position to the toner-free portion of the development roller 4*a* is 6 mm in diameter. The portion of the development roller 4*a*, which corresponds in position to the second area of contact, is 85 degrees in hardness, whereas the toner-free portion of the development roller 4*a* is 55 degrees in hardness. In this embodiment, the upper limit for the hardness of the portion of the development roller 4*a*, which corresponds in position to the second area of contact is 85 degrees. If this portion of the development roller 4*a* is greater in hardness than 85 degrees, toner is subjected to an excessive amount of stress, being thereby hastened in deterioration, as it is coated on (supplied to) the peripheral surface of the development roller 4*a*. Therefore, the image forming apparatus is likely to output unsatisfactory images significantly sooner than when this portion of the development roller 4*a* is no more than 85 degrees in hardness. Incidentally, the hardness of the development roller 4*a* was measured with the use of an Asker Hardness Tester-Type C (product of Asker Co.).

<Version 2 (FIG. 3(*b*))>

In this version, the portion of the metallic core 4*a*1, which corresponds in position to the second area of contact, was 10 mm in diameter, whereas the portion of the metallic core 4*a*1, which corresponds in position to the toner-free portion of the development roller 4*a*, was 6 mm in diameter, as in the first version of this embodiment. In terms of hardness, the portion of the development roller 4*a*, which corresponds in position to the second area of contact, is 85 degrees, whereas the portion of the development roller 4*a*, which corresponds in position to the toner-free portion of the development roller 4*a*, was 55 degrees, as they were in the first version.

<Version 3 (FIG. 3(*c*))>

In this version, the portion of the metallic core 4*a*1, which corresponds in position to the second area of contact, was 10 mm in diameter, whereas the portion of the metallic core 4*a*1, which corresponds in position to the toner-free portion of the development roller 4*a*, was 6 mm in diameter, as in the first version of this embodiment. However, this version is different from the first and second versions in that in terms of the diameter of the metallic core 4a1 of the development roller 4a, there is a step between the portion of the metallic core 4a1, which corresponds in position to the second area of contact, and the portion of the metallic core 4a1, which corresponds in position to the toner-free portion of the development roller 4a, in the first and second versions, whereas in the third version, the portion of the metallic core 4a1, which corresponds in position to the area between the second area of contact and the toner-free portion of the development roller 4a, is tapered in such a manner that the closer to the lengthwise center of the development roller 4a, the larger in diameter. In terms of hardness, the portion of the development roller 4a, which corresponds in position to the second area of contact, was 85 degrees, whereas the toner-free portion of the development roller 4a was 55 degrees.

<Version 4 (FIG. 3(*d*))>

In this version, the portion of the metallic core 4a1, which corresponds in position to the second area of contact, was 10 mm in diameter, and the portion of the metallic core 4a1, which corresponds in position to the toner-free portion of the elastic layer 4a2 was 4 mm in diameter. That is, in this version, the portion of the metallic core 4a1 which corresponds in position to the toner-free portion of the elastic layer 4a2 is smaller in diameter, in comparison to the first to third versions. In this version, the portion of the development roller 4a, which corresponds in position to the second area of contact, was 85 degrees in hardness, and the portion of the metallic core 4a1, which corresponds in position to the toner-free portion of the development roller 4a, was 40 degrees in hardness.

<Version 5 (FIG. 3(*e*))>

In this version, the portion of the metallic core 4a1, which corresponds in position to the second area of contact, was 10 mm in diameter, and the portion of the metallic core 4a1, which corresponds in position to the toner-free portion of the metallic core 4a1, was 8 mm in diameter. That is, in this version, the portion of the metallic core 4a1, which corresponds in position to the toner-free portion of the metallic core 4a1, was larger in diameter, in comparison to the first to third versions. In this version, the portion of the metallic core 4a1, which corresponds in position to the second area of contact, was 85 degrees in hardness, and the portion of the metallic core 4a1, which corresponds in position to the toner-free portion of the development roller 4a, was 70 degrees in hardness.

(6) Evaluation of Results

In order to verify the effects of this embodiment, the results of the first to fifth versions of this embodiment were compared with the effects of comparative examples 1 and 2 of development roller.

Comparative Example 1

In this comparative example, the metallic core of the development roller was uniform in diameter from one end to the other, in terms of the axial direction of the development roller, and was 10 mm in diameter. Further, the development roller was uniform in hardness from one end to the other in terms of the axial direction of the development roller, and was 85 degrees in hardness.

Comparative Example 2

In this comparative example, the metallic core of the development roller was uniform in diameter from one end to the other in terms of the axial direction of the development roller, and was 4 mm in diameter. Further, the development roller was uniform in hardness from one end to the other in terms of the axial direction of the development roller, and was 40 degrees in hardness.

Table 1 shows the results of the evaluation of an experiment test in which roughly 3,000 prints were made with the use of the development rollers 4a in the first to fifth versions of the preferred embodiment of the present invention, and the development rollers in the comparative examples 1 and 2, in an environment in which temperature was 25° C.

TABLE 1

| | core (toner-supply) | | | core (non-toner-supply) | | | evaluation | |
|---|---|---|---|---|---|---|---|---|
| | ϕ (mm) | width | hrdnss (deg) | ϕ (mm) | hardness (deg) | connect part | elastic layer scrape | image defect |
| Emb. 1 | 10 | supply roller width | 85 | 6 | 55 | stepped | ○ | ○ |
| Emb. 2 | 10 | regulating blade width | 85 | 6 | 55 | stepped | ○ | ○ |
| Emb. 3 | 10 | supply roller width | 85 | 6 | 55 | tapered | ○ | ○ |
| Emb. 4 | 10 | supply roller width | 85 | 4 | 40 | stepped | ○ | ○ |
| Emb. 5 | 10 | supply roller width | 85 | 8 | 70 | stepped | Δ | ○ |
| Comp. 1 | 10 | — | 85 | 10 | 85 | — | X | X |
| Comp. 2 | 4 | — | 40 | 4 | 40 | — | ○ | X |

Referring to Table 1 which shows the results of the visual evaluation of the peripheral surface of the development roller 4a after the completion of the experiment, in the case of the first to third versions of the preferred embodiment, no sign of shaving of the elastic layer 4a2 of the development roller 4a was detected either across the toner bearing portion or the toner-free portion. Further, no unsatisfactory image was outputted at all through the entirety of the experiment. This makes it reasonable to make the following theoretical conclusions. That is, in the first to third versions of the preferred embodiment, the portion of the metallic core of the development roller, which corresponds in position to the toner-free portion of the elastic layer 4a2, was smaller in diameter than the portion of the metallic core 4a1, which corresponds in position to the toner bearing portion of the elastic layer 4a2 of the development roller. Therefore, the toner-free portion of the elastic layer 4a2 of the development roller 4a in these versions of the preferred embodiment was smaller in the amount of the stress generated therein in the direction parallel to the circumferential direction of the development roller 4*a*, being therefore significantly smaller in the amount by which it was shaved by the peripheral surface of the photosensitive drum 1, than that of the development rollers in accordance with any of the prior arts. Moreover, the fourth version of the preferred embodiment also was significantly smaller in the amount by which the elastic layer 4*a*2 was shaved was significantly smaller than the comparative examples, and output no unsatisfactory image.

In the case of the fifth version of the preferred embodiment, the visual evaluation of the peripheral surface of the development roller 4*a* after the completion of the experiment confirmed that the toner-free portion of the elastic layer 4*a*2 was shaved by a small amount, that is, an amount in a tolerable range. Further, an unsatisfactory image was not outputted throughout the experiment. The comparison between the test results of the fifth version of the preferred embodiment, and the test results of the first to fourth versions of the preferred embodiment suggests that the toner-free portion of the development roller 4*a* in the fifth version was harder than the toner-free portion of the development roller 4*a* in any of the first to fourth version, and therefore, it was shaved by the peripheral surface of the photosensitive drum 1, although by only a small amount. Thus, it seems to be reasonable to conclude from this comparison that the toner-free portion of the development roller 4*a* is desired to be no more than 70 degrees.

On the other hand, in the case of the first comparative example, the image forming apparatus began to output unsatisfactory images, more specifically, images which suffer from vertical streaks, after it outputted roughly 1,000 prints. Then, the cleaning blade was lapped at roughly the 1,500th print. Further, the visual evaluation of the peripheral surface of the development roller at the end of the evaluation test revealed that the toner-free portion of the elastic layer was significantly shaved. It seems that since the toner-free portion of the development roller in the first comparative example was harder, it was shaved by the peripheral surface of the photosensitive drum 1, which in turn caused the cleaning blade to lap, and/or the image forming apparatus to output unsatisfactory images.

In the case of the second comparative example, the visual evaluation revealed no sign of the shaving of the elastic layer. However, the image forming apparatus outputted prints which were unsatisfactory in that they are nonuniform in density, being lower in density across the center portion. The further visual evaluation of these unsatisfactory images confirmed the following. The development roller in the second comparative example was not as hard as the other development roller across the entirety in terms of its axial direction. Thus, its deformation prevented it from remaining properly in contact with the peripheral surface of the photosensitive drum 1, in particular, across the center portion of the photosensitive drum 1, which resulted in the outputting of the above described unsatisfactory images by the image forming apparatus. On the other hand, it seems that because of the toner-free portion of the development was less in hardness, the amount by which it was shaved by the peripheral surface of the photosensitive drum was not significant.

As will be evident from the detailed description of the preferred embodiment of the present invention, according to the present invention, the toner-free portion of the elastic layer 4*a*2 of the development roller 4*a* can be minimized by relatively inexpensive change in the structure of the development roller 4*a*, more specifically, forming a development roller 4*a* so that the portion of its metallic core 4*a*1, which corresponds in position to the toner-bearing portion of the development roller 4*a* are different in diameter from the portion of the metallic core 4*a*1, which corresponds in position to the toner-free portion of the development roller 4*a*. Thus, the present invention can provide an image forming apparatus which meets the demand from users, without inviting such problems that the particles resulting from the shaving of the elastic layer of the development roller travel to the cleaning edge of the cleaning blade, causing thereby the cleaning blade to generate abnormal sounds, and/or preventing the cleaning blade from satisfactorily clean the peripheral surface of the photosensitive drum 1. Also according to the present invention, the toner bearing portion of the elastic layer 4*a*2 of the development roller 4*a* is hard enough to ensuring that the peripheral surface of the photosensitive drum 1 is supplied with a satisfactory amount of toner. Therefore, the employment of a development roller in accordance with the present invention by an image forming apparatus ensures that the apparatus continuously outputs images of satisfactory quality.

That is, the present invention makes it possible to provide a development roller which is inexpensive in structure and significantly smaller in the amount by which its elastic layer is shaved away by the peripheral surface of an image bearing member, than any of development rollers in accordance with prior arts, and therefore, can minimize an image forming apparatus which uses a developing method of the contact type, in the problems attributable to the cleaning blade and the particles resulting from the shaving.

INDUSTRIAL APPLICABILITY

According to the present invention, a combination of an image forming apparatus and a process cartridge therefor, which uses a development method of the contact type, is inexpensive to manufacture, substantially lower in the amount by which its development roller is shaved, and unlikely to suffer from the problems related to its cleaning blade.

While the invention has been described with reference to the structures disclosed herein, it is not confined to the details set forth, and this application is intended to cover such modifications or changes as may come within the purposes of the improvements or the scope of the following claims.

The invention claimed is:

1. A process cartridge detachably mountable to a main assembly of an image forming apparatus, said process cartridge comprising:

an image bearing member on which an electrostatic image is to be formed;

a developing roller, including a shaft member and an elastic layer therearound, for developing the electrostatic image while contacting a surface of said image bearing member at a peripheral velocity higher than a peripheral velocity of said image bearing member;

a toner supplying roller contactable to said developing roller;

a regulating member, contactable to said developing roller, for regulating a layer thickness of toner carried on a surface of said developing roller, wherein a length of said regulating member measured in a rotational axial direction of said developing roller is shorter than that of said developing roller; and a cleaning blade, contactable to said image bearing member, for cleaning said surface of said image bearing member;

wherein said developing roller has a first region capable of carrying the toner regulated by said regulating member and a second region, outside of said first region, not carrying the toner, both of said first and second regions being contactable to said image bearing member, and said first and second regions being different with respect to the rotational axis direction, wherein said cleaning blade extends over said first and second regions when said cleaning blade is contacted to said image bearing member, wherein said shaft member has a first outer diameter in a region outside a first contact region between said regulating member and said developing roller, and a second outer diameter in a second contact region between said toner supplying roller and said developing roller, the first outer diameter being smaller than the second outer diameter, wherein, when said image bearing member and said developing roller rotate, said elastic layer deforms toward an upstream side with respect to the rotational direction of said developing roller by contacting said image bearing member, and wherein an amount of deformation of said elastic layer covering such a portion of said shaft member having the first outer diameter is larger than an amount of deformation of said elastic layer covering such a portion of said shaft member having the second outer diameter.

2. A process cartridge according to claim 1, wherein said toner supplying roller has a length, measured in the rotational axis direction, which is shorter than a length of said regulating member.

3. A process cartridge according to claim 1, wherein the portions of said shaft member that have different outer diameters constitute stepped portions.

4. A process cartridge according to claim 1, wherein the portions of said shaft member that have different outer diameters are connected by a tapered portion.

5. An image forming apparatus comprising:

an image bearing member on which an electrostatic image is to be formed;

a developing roller, including a shaft member and an elastic layer therearound, for developing the electrostatic image while contacting a surface of said image bearing member at a peripheral velocity higher than a peripheral velocity of said image bearing member;

a toner supplying roller contactable to said developing roller;

a regulating member, contactable to said developing roller, for regulating a layer thickness of toner carried on a surface of said developing roller, wherein a length of said regulating member measured in a rotational axial direction of said developing roller is shorter than that of said developing roller;

a transferring device for transferring a toner image formed on said image bearing member onto a toner image receiving member; and a cleaning blade, contactable to said image bearing member, for cleaning the surface of said image bearing member;

wherein said developing roller has a first region capable of carrying the toner regulated by said regulating member and a second region, outside of said first region, not carrying the toner, both of said first and second regions being contactable to said image bearing member, and said first and second regions being different with respect to the rotational axis direction, wherein said cleaning blade extends over said first and second regions when said cleaning blade is contacted to said image bearing member, and wherein said shaft member has a first outer diameter in a region outside a first contact region between said regulating member and said developing roller, and a second outer diameter in a second contact region between said toner supplying roller and said developing roller, the first outer diameter being smaller than the second outer diameter, wherein, when said image bearing member and said developing roller rotate, said elastic layer deforms toward an upstream side with respect to the rotational direction of said developing roller by contacting said image bearing member, and wherein an amount of deformation of said elastic layer covering such a portion of said shaft member having the first outer diameter is larger than an amount of deformation of said elastic layer covering such a portion of said shaft member having the second outer diameter.

6. An apparatus according to claim 5, wherein said toner supplying roller has a length, measured in the rotational axis direction, which is shorter than a length of said regulating member.

7. An apparatus according to claim 5, wherein the portions of said shaft member that have different outer diameters constitute stepped portions.

8. An apparatus according to claim 5, wherein the portions of said shaft member that have different outer diameters are connected by a tapered portion.

* * * * *